United States Patent [19]

Rank, Jr.

[11] Patent Number: 4,597,751

[45] Date of Patent: Jul. 1, 1986

[54] METHOD AND APPARATUS FOR BINDING PAPER

[76] Inventor: Allen H. Rank, Jr., 270 N. Eisenhower La., Lombard, Ill. 60148

[21] Appl. No.: 648,746

[22] Filed: Sep. 10, 1984

[51] Int. Cl.[4] ..... B31B 21/26; B31B 29/02; B65H 45/22

[52] U.S. Cl. ..... 493/403; 493/400; 412/6; 271/171

[58] Field of Search ..... 493/403, 355, 400, 401, 493/402; 271/171

[56] References Cited

U.S. PATENT DOCUMENTS

| | | | |
|---|---|---|---|
| 1,463,879 | 8/1923 | Downing | 493/399 |
| 1,574,789 | 3/1926 | Burgess | 493/399 |
| 3,157,398 | 11/1964 | Zahradnik | 493/403 |
| 3,731,600 | 5/1973 | Earp | 493/400 |
| 4,098,501 | 7/1978 | Tani et al. | 271/171 |
| 4,417,883 | 11/1983 | Granger et al. | 493/403 |

FOREIGN PATENT DOCUMENTS

| | | | |
|---|---|---|---|
| 135596 | 5/1979 | German Democratic Rep. | 493/403 |

*Primary Examiner*—Francis S. Husar
*Assistant Examiner*—William E. Terrell
*Attorney, Agent, or Firm*—Welsh & Katz, Ltd.

[57] ABSTRACT

A modular desktop paper scoring apparatus and method for using the scoring apparatus for binding papers is disclosed. The scoring apparatus comprises a pair of rollers, one being of a resilient material, and the other roller being of a hardened material with a peripheral projection or rib positioned in its midsection. On feeding a strip of paper through the rollers, the rib scores the paper, which may then be folded along the score line and used to bind papers.

5 Claims, 5 Drawing Figures

METHOD AND APPARATUS FOR BINDING PAPER

This invention relates to an apparatus for scoring paper and more particularly to a method and desktop apparatus for scoring binding material for use in binding papers.

BACKGROUND OF THE INVENTION

It has been known to score paper and other thin materials in order to facilitate bending of the materials during use and provide a means for accurate folding of the material along specific lines. While large industrial scoring apparatus have been known for scoring corrugated paper for forming boxes and the like, there has been no apparatus of a size conducive to use in a business office for scoring paper and in particular heavy paper, for forming a binder for a plurality of sheets of paper as may be found in a report, blueprints for a structure, or the like.

SUMMARY OF THE INVENTION

Therefore an object of the subject invention is an improved scoring apparatus of modular construction.

Another object of the subject invention is an improved scoring apparatus having an automatic feed.

A further object of the subject invention is a method for forming a binder for papers.

A still further object of the subject invention is a method for automatically scoring paper of semi-rigid construction for use as a binder for papers.

These and other objects are attained in accordance with the subject invention wherein a method for scoring elongated papers and the desktop apparatus therefor is provided. The apparatus of the subject invention comprises a modular or desktop device having a paper feeding chute for the alignment and feeding of paper to a pair of adjacent oppositely turning rollers. An upper roller is formed of a resilient elastomeric material. A lower roller is formed of a hardened material such as stainless steel or the like, and has at least one peripheral projection or scoring wedge in its midsection. The upper roller is driven by a fractional horsepower motor whose output is geared down to the desired speed. The bottom roller is positioned on an axis parallel to the upper roller and frictionally engages the upper roller end, being driven thereby. A feed chute of desired width is mounted perpendicular to the upper and lower roller axis. In the method of the subject invention, a length of paper of strong durable stock is fed through the feed chute for contact with the rotating rollers, which force the paper therethrough. In its travel between the rollers the paper is scored by the action of the scoring wedge on the paper. The paper is driven completely through the rollers, being scored its entire length. The scored paper is taken up as it exits the rollers, and folded on the scored portion to create a double thickness. The creased and folded paper strip of paper is then placed against an edge of a plurality of papers and secured as by stapling or the like.

DETAILED DESCRIPTION OF THE DRAWINGS

Further objects of the invention, together with additional features contributing thereto and advantages accruing therefrom, will be apparent from the following description of one embodiment of the invention when read in conjunction with the accompanying drawings, wherein.

Figure 1:
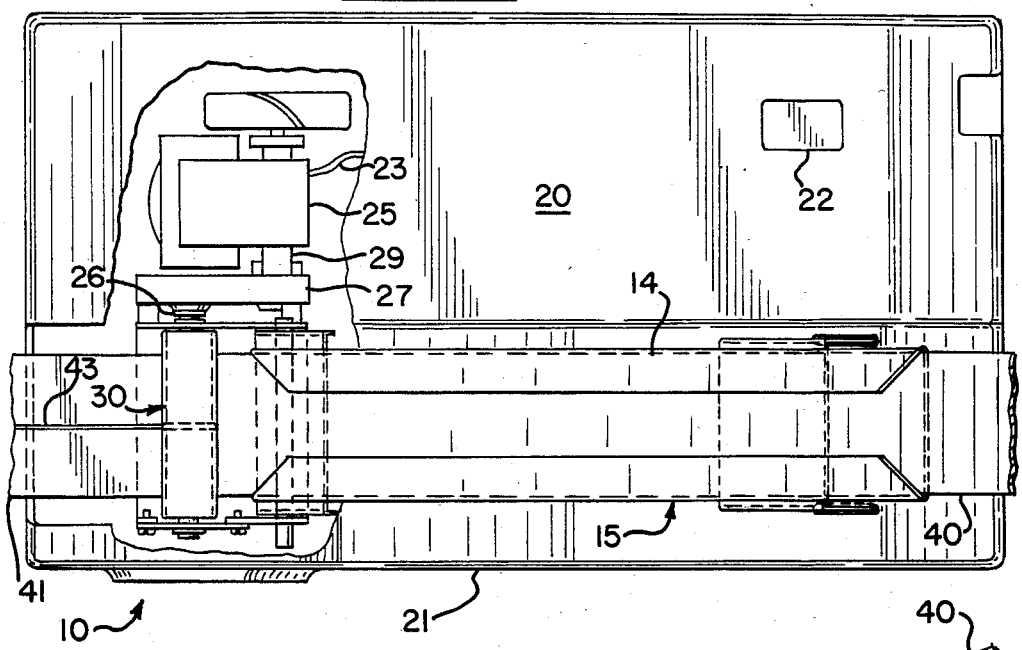
FIG. 1 is a top plan view of one embodiment of the improved scoring apparatus of the subject invention showing a portion of the outer case cut away to show the drive means.

Referring now to FIG. 1 there is shown one embodiment of the scoring apparatus 10 of the subject invention, having a feed chute assembly 15, shown accepting an elongated strip of paper 40, generally of predetermined width, roughly equivalent to the interior width of feed chute 14. The strip of paper is fed through chute assembly 15 to roller assembly 30 which it passes through and emerges as paper strip 41 having score 43 therein in its midsection.

In general the scoring apparatus 10 comprises a bottom frame 21 surrounded by housing 20. Within housing 20, as shown in the cutaway portion, is fractional horsepower motor 25 of a commercially available type, having output shaft 26 connected to the roller assembly 30 through gear box 27. A rocker arm switch 22 or the like may be connected to fractional horsepower motor 25 through wires 23 for switching the apparatus on.

Figure 2:
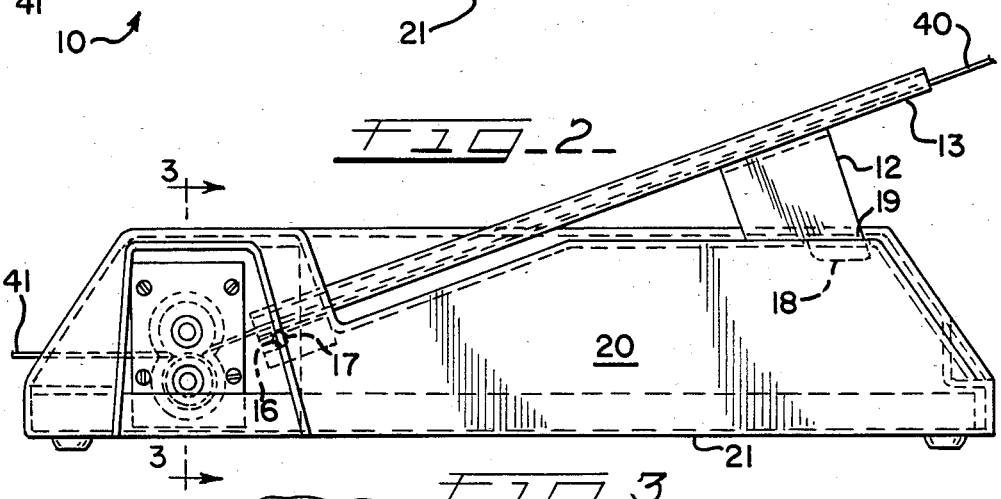
FIG. 2 is a side plan view of the embodiment of FIG. 1.

Feed chute assembly 15 is shown in more detail in FIG. 2 to comprise a channel or throat 14 having a roller feed end portion having a slot 16 removably engageable with rod or pin 17 for support thereon. Chute 14 comprises a partially enclosed ramp through which the paper is fed for proper orientation to the rollers. At its free or feed end portion 13 a strut support 12 is fixedly secured to the underside of the channel 14. Tabs 18 on the strut 12 may be removably secured in corresponding slots 19. The feed channel 14 may thus be easily secured in place for use by locating slot 16 about rod 17 and dropping tabs 18 into slots 19. The feed channel may be easily removed from this position for storage by reversing this sequence. Feed chute assemblies having chutes 14 of different widths may be provided to permit different sizes of binding paper to be used. Widths as great as the width of a roller (to be described) may be used, while widths as small as feasible to bind a sheaf of papers are possible. Chute assembly 15 is positioned relative to rollers 32 and 34 so that a strip of paper feed through chute 14 is oriented or guided for contact by the rollers, followed by immediate engagement and movement between and past the rollers in their scoring action.

Figure 3:
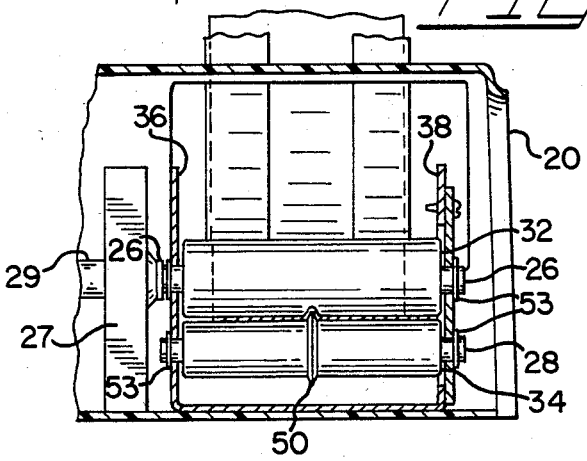
FIG. 3 is a cross-sectional view taken along line 3—3 of FIG. 2 showing the roller assembly in more detail.

As shown in FIGS. 2 and 3, the roller assembly 30 is driven by fractional horsepower motor 25 connected to gear box 27 through drive means or axle 29. The high revolutions of axle 29 driven by motor 25 is translated into a much lower and usable speed in terms of revolutions per minute by gear box 27. The drive output of gear box 27 is roller drive means or shaft 26 which drives upper or resilient roller 32. Upper roller 32 is mounted for rotational movement in conjunction with shaft 26 between roller supports 36 and 38 to which it is secured for free rotation by suitable fasteners 53. Lower or scoring roller 34 is also mounted between roller frames 36 and 38 on axle or shaft 28 for rotation thereabout and for frictional surface engagement with upper or resilient roller 32. Axle 28 is secured in place for free rotation by fasteners 53 in a manner to allow easy removal for reasons to become apparent. Upon the rotation of the upper roller 32, lower roller 34 will follow, though in an opposite rotational mode.

Lower roller 34 has in its midsection a circumferentially extending projection or rib 50 of constant cross-section and extending completely therearound. Upper roller 32 has a smooth outer periphery of a relatively resilient material. Adjacent rib 50 of lower roller 34 on either side thereof are two generally flat cylindrical areas extending to either end of each roller, thereby forming a roller length of approximately the same size as the width of paper being fed between the rollers.

Figure 4:
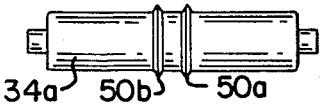
FIG. 4 is a side plan view of a second embodiment of a lower roller which may be used in the subject invention.

An alternative lower roller **34*a* is shown in FIG. 4, having two scoring ribs 50*a* and 50*b* for providing two scores in the paper strip and thus provide accommodation for binding a thicker sheaf of papers. The distance between ribs 50*a* and 50*b*** may be varied to permit a variety of thickness of paper to be bound. A plurality of rollers with differently spaced ribs would be provided for this purpose. By removing the lower roller and replacing it with a roller having the desired rib spacing, different size report thicknesses can be easily accommodated.

In operation, the scoring apparatus is turned on by depressing switch 22 which commences operation of the motor 25 for rotating rollers 32 and 34. A strip of unscored paper 40 sized to fit the feed chute 14 is fed into chute 14 and manually maneuvered downwardly while it is oriented by chute 14 for contact with the rollers. The rollers are rotating at a desired speed, being driven by fractional horsepower motor 25 through gear box 27. On contact of the unscored paper 40 with the rollers, the paper is frictionally engaged by the oppositely rotating rollers and is caused to be drawn between rollers 32 and 34, thereby being scored by the action of rib 50 pressing against resilient roller 32 in the movement of the paper between the rollers.

On exiting the rollers 32 and 34, the length of paper 41, now having score or crease 43 in its midsection corresponding to the location of rib 50, may be either caught manually or directed to fall into a bin (not shown) where it may be picked up later.

Figure 5:
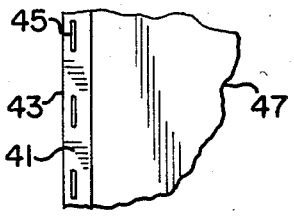
FIG. 5 is a top plan view of a portion of a plurality of papers bound utilizing the method and apparatus of the subject invention.

The scored paper 41 may then be folded along the score line 43 and used as binding material for a plurality of papers as shown in FIG. 5. By folding the scored paper 41 along the crease 43, a double thickness paper is created in the form of a "v". The papers 47 are inserted at the open end of the "v" and secured together as by staples 45 or other fastening means in a manner known in the art.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A lightweight portable desktop apparatus for use in scoring elongated paper of limited width, said paper being suitable for binding paper sheaves, said apparatus comprising;

a frame sized for supporting said apparatus on a business desk;

a modular housing mounted on said frame and substantially enclosing said apparatus;

a first roller and a second roller, said first roller and said second roller being mounted on first and second axles respectively, each of said axles being supported by a pair of roller supports mounted on said frame;

said second axle being mounted for easy removal and replacement of said second roller;

said first roller having a generally flat surface, said second roller having at least one circumferential projection about its midsection, said first roller being of a resilient material, said second roller being of a rigid material;

said second roller being selected from rollers having different numbers of circumferential projections and spacing between projections so as to allow the use of different thicknesses of paper and different scoring formats;

said first roller being operatively connected through a gear box to a fractional horsepower motor for rotational movement therewith, said gear box lowering the rotational output of said motor to a selected speed;

said second roller being adjacent said first roller and in physical contact therewith so as to be driven in following rotational movement by said first roller but in an opposite direction; and guide means comprising an elongated chute oriented towards said rollers having inwardly extending upper side flanges for retention of said elongated paper within said chute so as to orient and feed said elongated strip of paper to said rollers, where the rotational movement of said rollers causes engagement with said oriented paper, and the scoring and subsequent movement of said paper away from said rollers, said elongated chute being removable and replaceable with elongated chutes of different widths for use with elongated paper of different widths, said guide means and said frame all being in modular form and of a size as will permit placement on said business desk.

2. The apparatus of claim 1 further including a generally flat cylindrical section immediately adjacent either side of said projection on said second roller.

3. The apparatus of clam 1 wherein said guide means comprises a partially enclosed ramp.

4. The apparatus of claim 1 wherein said guide means is selected from guide means of various selected widths.

5. The apparatus of claim 1 wherein said second roller has two circumferential projections.

* * * * *